US007833083B2

(12) United States Patent
Sobah-Wilhelm

(10) Patent No.: US 7,833,083 B2
(45) **Date of Patent: *Nov. 16, 2010**

(54) BRA AND/OR BRA PAD FOR PROVIDING THE APPEARANCE OF SYMMETRY TO ASYMMETRICAL BREASTS

(76) Inventor: Mary C. Sobah-Wilhelm, 28310 Manhattan, St. Clair Shores, MI (US) 48081

( * ) Notice: Subject to any disclaimer, the term of this patent is extended or adjusted under 35 U.S.C. 154(b) by 153 days.

This patent is subject to a terminal disclaimer.

(21) Appl. No.: 12/192,615

(22) Filed: Aug. 15, 2008

(65) Prior Publication Data

US 2008/0305714 A1 Dec. 11, 2008

Related U.S. Application Data

(63) Continuation of application No. 11/776,224, filed on Jul. 11, 2007, now Pat. No. 7,413,495.

(60) Provisional application No. 60/909,020, filed on Mar. 30, 2007.

(51) Int. Cl.
*A41C 3/00* (2006.01)

(52) U.S. Cl. ..... 450/39; 450/36; 2/267

(58) Field of Classification Search ..... 450/36–39, 450/54–58, 1, 41; 2/267, 8
See application file for complete search history.

(56) References Cited

U.S. PATENT DOCUMENTS 2,495,307 A 1/1950 Abramson
2,779,943 A 2/1957 Kelleher
2,824,563 A 2/1958 Hill
2,915,067 A 12/1959 Bracht
3,094,125 A 6/1963 Lewis
3,311,112 A 3/1967 Murray ..... 450/1
3,392,731 A 7/1968 Silverman
3,701,168 A 10/1972 Balow ..... 3/36
3,826,266 A * 7/1974 Alpert ..... 450/11
3,950,792 A 4/1976 Williams ..... 3/36

(Continued)

FOREIGN PATENT DOCUMENTS

FR 2889032 7/2005

(Continued)

OTHER PUBLICATIONS

Carolyn Fox, "A 'Boob Thing'", American Observer, May 18, 2007, http://observer.american.edu/021506/Boobpg1_021506.html.

(Continued)

*Primary Examiner*—Gloria Hale
(74) *Attorney, Agent, or Firm*—Christopher P. Maiorana, PC

(57) ABSTRACT

A breast covering garment apparatus having a first breast cup and a second breast cup. The first and second breast cups may have (i) an inner shell having a concave shape selected from a number of available cup sizes and (ii) an outer shell having a convex shape selected from a number of available cup sizes. The inner shell of the first breast cup and the inner shell of the second breast cup may be different cup sizes. The outer shell of the first breast cup and the outer shell of the second breast cup may be the same cup size.

20 Claims, 7 Drawing Sheets

U.S. PATENT DOCUMENTS

| | | | | |
|---|---|---|---|---|
| 4,172,002 | A | 10/1979 | Gluckin | |
| 4,185,332 | A | 1/1980 | Jahnig | 3/36 |
| 4,222,387 | A | 9/1980 | Tetu | 128/460 |
| 4,269,191 | A | 5/1981 | Evans | 128/488 |
| 4,369,792 | A | 1/1983 | Miller | 128/479 |
| 4,372,321 | A | 2/1983 | Robinson | |
| 4,740,258 | A | 4/1988 | Breitscheidel | |
| 4,867,826 | A | 9/1989 | Wayte | |
| 5,066,302 | A | 11/1991 | Rice | |
| 5,180,326 | A | 1/1993 | Williams | 450/91 |
| 5,334,082 | A | 8/1994 | Barker | 450/31 |
| 5,749,768 | A | 5/1998 | Green | 450/65 |
| 5,967,877 | A | 10/1999 | Howard | |
| 6,015,332 | A | 1/2000 | Lee et al. | 450/57 |
| 6,048,252 | A | 4/2000 | Sebring | 450/1 |
| 6,055,668 | A | 5/2000 | Gros et al. | 2/69 |
| 6,101,630 | A | 8/2000 | Lee | 2/57 |
| 6,110,006 | A | 8/2000 | Chen | 450/57 |
| 6,231,423 | B1 | 5/2001 | Deal et al. | 450/57 |
| 6,390,885 | B1 * | 5/2002 | Brooks | 450/1 |
| 6,425,800 | B1 | 7/2002 | Huang | |
| 6,439,960 | B1 | 8/2002 | Fildan et al. | |
| 6,811,464 | B2 | 11/2004 | Li | |
| 6,935,921 | B1 | 8/2005 | Eudenbach et al. | 450/54 |
| 6,966,815 | B2 | 11/2005 | Weinerth | |
| 7,001,240 | B1 | 2/2006 | Huffman-Jimenez | 450/58 |
| 7,052,360 | B2 | 5/2006 | Lau | |
| 7,118,444 | B2 * | 10/2006 | Newman | 450/58 |
| 7,381,113 | B2 | 6/2008 | Hori | |
| 7,413,495 | B1 * | 8/2008 | Sobah-Wilhelm | 450/58 |
| 2002/0102913 | A1 | 8/2002 | Courtney et al. | 450/57 |
| 2005/0037687 | A1 | 2/2005 | Newman | 450/54 |
| 2006/0052035 | A1 | 3/2006 | Walker | |
| 2006/0079153 | A1 | 4/2006 | Davidson | 450/58 |
| 2006/0276105 | A1 | 12/2006 | Han | |
| 2007/0004315 | A1 | 1/2007 | Luk et al. | |
| 2007/0117495 | A1 | 5/2007 | Walker | |
| 2007/0298681 | A1 | 12/2007 | Liu | |
| 2008/0032598 | A1 | 2/2008 | Bentham et al. | |

FOREIGN PATENT DOCUMENTS

| | | |
|---|---|---|
| JP | 2003-227009 | 8/2003 |
| JP | 2004256956 A | 9/2004 |

OTHER PUBLICATIONS

"Sylene's . . . Fine Lingerie On-line", May 18, 2007, http://www.sylenes.com.

"Park Masectomy Bras", May 18, 2007, http://www.parkmastectomy.com/Merchant2/merchant.mvc?Screen=CTGY&Category_Code=BAS_MB.

"Jodee #345 Perma Form Masectomy Bra", May 18, 2007, http://www.parkmastectomy.com/Merchant2/merchant.mvc?Screen=PROD&Product_Code=Jodee_345&Category_Code=.

* cited by examiner

BRA AND/OR BRA PAD FOR PROVIDING THE APPEARANCE OF SYMMETRY TO ASYMMETRICAL BREASTS

This is a continuation of U.S. Ser. No. 11/776,224, filed Jul. 11, 2007, now U.S. Pat. No. 7,413,495, issued Aug. 19, 2008.

This application claims the benefit of U.S. Provisional Application No. 60/909,020, filed Mar. 30, 2007, and is hereby incorporated by reference in its entirety.

FIELD OF THE INVENTION

The present invention relates to bra garments generally, and, more particularly, to a bra and/or bra pad to provide the appearance of symmetry to asymmetrical breasts.

BACKGROUND OF THE INVENTION

Most or all women have some degree of breast asymmetry (i.e., un-even breasts). Even if a woman has breasts with cup sizes that differ by less than a half-cup size, such a difference can be noticeable. While many women suffer from natural breast abnormalities, other women have disfigured breasts as a result of the treatment for breast cancer or other breast surgeries. According to World Health Organization, over 1.2 million women will be diagnosed with breast cancer worldwide, many of whom will need to have a lumpectomy. According to the American Cancer Society approximately 1 out of 8 women will be diagnosed with breast cancer in the U.S. alone.

Uneven breasts have undesirable effects that can impact daily life, sexuality and confidence of affected women. While most or all women have some degree of breast asymmetry, many are suffering from abnormalities and deformities caused by a lumpectomy, a tuberous breast, Poland Syndrome or Congenital Micromastia. A lumpectomy is the surgical removal of a tumor, normally as a treatment for breast cancer. A tuberous breast occurs when the breast is narrow instead of round from the top to bottom, resembling a tube shape. Often, the areola are puffy and protrude, making the breast look abnormal. The Poland Syndrome is a birth defect characterized by underdevelopment or absence of the chest muscle. Congenital Micromastia is a medical term for a condition commonly known as small breasts.

According to the Population Reference Bureau 2005 report, there were a total of 3,209,000,000 women in the world. The total lingerie market in 2003 amounted to $29.5 billion. Bras accounted for a significant amount of total lingerie sales. Sales of lingerie are expected to increase to 31.6 billion by the year 2012. The average woman in the developed world owns a number of bras. However, there are no bras that both (i) fit abnormally shaped breasts and (ii) cause both breasts to appear to be even.

It would be desirable to make a bra and/or bra pad that provides the appearance of symmetry to asymmetrical breasts.

SUMMARY OF THE INVENTION

The present invention concerns an apparatus comprising a first cup and a second cup. The first cup may comprise (i) an inner shell selected from a number of available cup sizes and (ii) an outer shell selected from a number of available cup sizes. The inner shell of the first cup and the outer shell of the first cup may be shaped from a first solid piece of flexible material. The second cup may comprise (i) an inner shell selected from the number of available cup sizes and (ii) an outer shell selected from the number of available cup sizes. The inner shell of the second cup and the outer shell of the second cup may be shaped from a second solid piece of flexible material. The inner shell of the first cup and the inner shell of the second cup may be different cup sizes and the outer shell of the first cup and the outer shell of the second cup may be the same cup size.

The objects, features and advantages of the present invention include implementing a bra and/or bra pad that may (i) provide the appearance of symmetry to asymmetrical breasts, (ii) provide padding to a smaller of the first cup or the second cup such that the first cup and the second cup have an equal outside size, (iii) provide gel to fill the void in the smaller cup, (iv) provide removable padding/gel pads and/or (v) provide gel pads that may be individually filled to a desired fullness.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
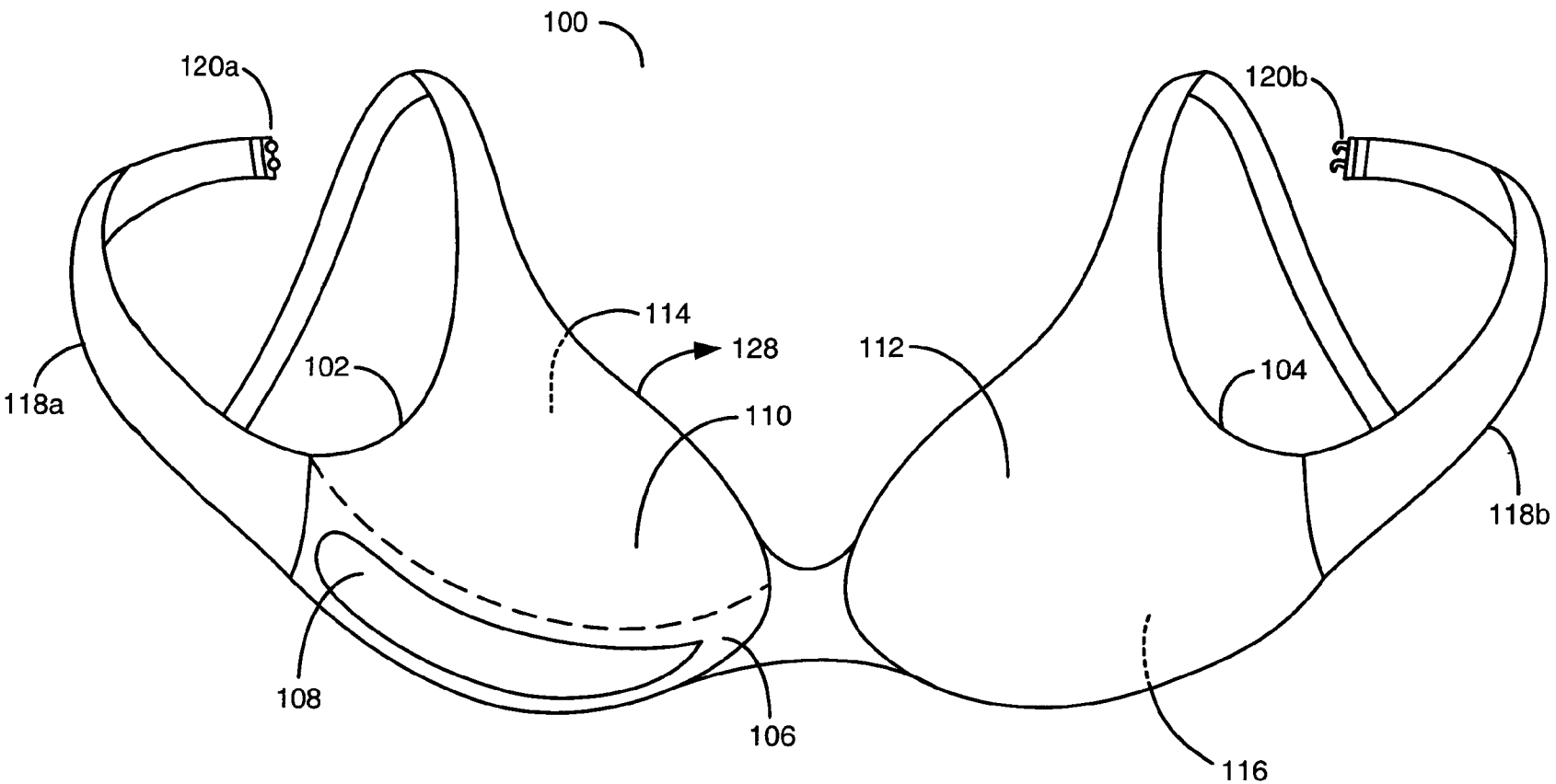
FIG. 1 is a diagram illustrating an example of a bra in accordance with the present invention.

Referring to FIG. 1, a diagram of system 100 is shown in accordance with a preferred embodiment of the present invention. The system 100 may be implemented as a bra, a sports bra, a brassier, a bikini top, a camisole, or other lingerie top. The system 100 generally comprises a cup 102 and a cup 104. The cup 102 and the cup 104 generally have the outer appearance of typical bra cups. In the example shown, the cup 104 may be implemented as a standard bra cup without enhancements. The cup 102 may be implemented as a bra cup with enhancements in accordance with the present invention. The cup 102 may be implemented to accommodate a different sized breast than a breast accommodated by the cup 104.

The cup 102 generally comprises a portion 106 and a portion 108. The portion 106 may be implemented as a pad. The portion 108 may be implemented as an enhanced portion. The portion 108 may be referred to as a cookie. The portion 108 may be filled with air, gel, foam gel, whipped gel, silicone, whipped silicone, saline or other types of non-solid substances and/or materials. The portion 106 may be formed using a solid piece of a flexible material, such as a piece of foam, a multi-ply foam piece, or other similar materials. The cup 102 may have a pre-formed outer shell 110. The cup 104 may have a pre-formed outer shell 112. The outer shell 110 and the outer shell 112 may be formed to have the same outer shape and/or dimensions. The cup 102 may have an inner shell 114. The cup 104 may have an inner shell 116. The inner shell 114 and the inner shell 116 may be different sizes and/or shapes. The cup 102 may contain the pad portion 106, the cookie portion 108 and/or other filling materials to fill the void between the inner cup 114 and the outer cup 110. In one example, the pad portion 106, the cookie portion 108 and/or other filling materials may be fused to the cup 102. However, other ways to connect the pad portion 106, the cookie portion 108, and/or the other filling materials may be implemented to meet the design criteria of a particular implementation. For example, glue and/or other suitable adhesives may be used. In general, the inner cup 114 may be formed to have a shape that accommodates a small or misshapen breast. The cup 102 may give a breast that is smaller than the other larger breast the appearance of symmetry when compared with the larger breast. The cup 102 may compensate for issues arising from surgery, birth defects and/or any other disfigurement.

In general, the cookie portion 108 may sit on or within the pad portion 106. The cookie portion 108 may be used to cause the breast to be pushed upward and over toward a center cleavage area, as shown by an arrow 128. Such enhancement may give the appearance of fullness, symmetry and a desirable shape to the breasts. Such enhancement may provide evenness to the appearance of the cleavage area, as shown by an arrow 128.

The bra 100 may also include a strap 118*a* and a strap 118*b*. The straps 118*a* and 118*b* may be connected together by a connecting device 120*a* and a connecting device 120*b*. The connecting devices 120*a* and 120*b* may be removably connected. The connecting devices 120*a* and 120*b* may be implemented as different sized clasps, rings, straps and/or any other appropriate connecting devices.

Figure 2A:
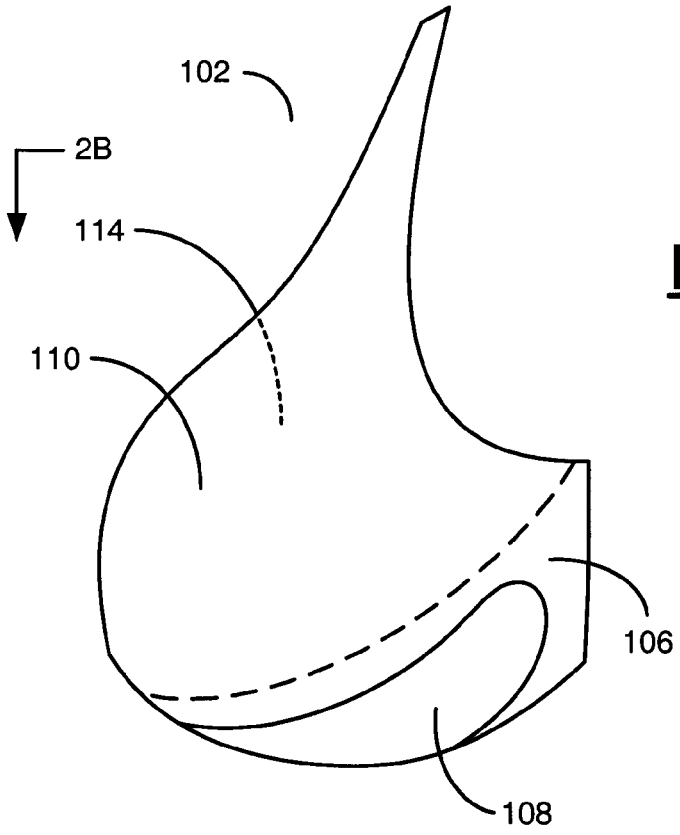
FIGS. 2*a-b* are diagrams illustrating outside views of a bra pad in accordance with the present invention.
Figure 2B:
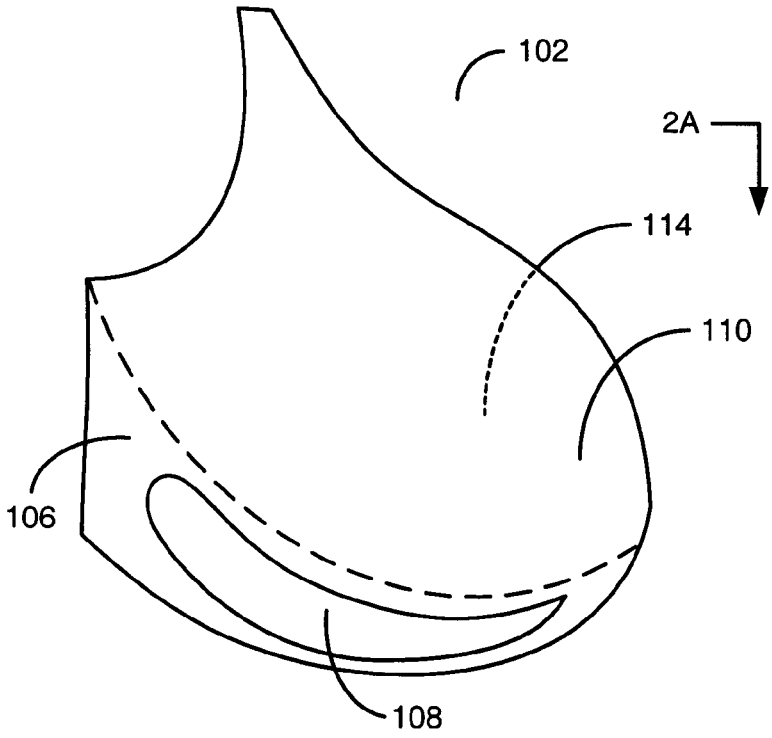

Referring to FIG. 2*a*, a side view of the cup 102 is shown. Referring to FIG. 2*b*, a front view of the cup 102 is shown. In one example, the cup 102 may be designed specifically to compensate for breast asymmetry and/or deformities as the result of surgery or birth defects. The present invention may be used to enhance one or both breasts. The cup 102 in FIGS. 2*a* and 2*b* illustrates various views of the pre-formed outer shell 110. The outer shell 110 may be designed to consistently maintain the shape and/or appearance of well formed and/or even breasts. In one example, the outer shell 110 may be consistent with the measurements of standard cup sizes (e.g., A, B, C, D, etc.).

The pad portion 106 and the cookie portion 108 may be made of foam or other substance such as whipped foam, gel, silicone, whipped silicone or other filler. Combinations of such materials may also be implemented. The cookie portion 108 may aid in filling or conforming to particular breast asymmetries. The pad portion 106 may fill a void between the outer shell 110 and the inner shell 114. The inner shell 114 may be created by the pad portion 106. The inner shell 114 may be consistent with a standard cup size (e.g., A, B, C, D, etc.) The void may be filled with padding, gel, one or more gel pads, removable pads, fill tubes, a combination of such materials, and/or any other materials. In one example, the pad portion 106 may be fused (or secured) directly onto the inside of the outer shell 110. While fusing has been described, various processes and/or adhesives may be used to meet the design criteria of a particular implementation.

Figure 3:
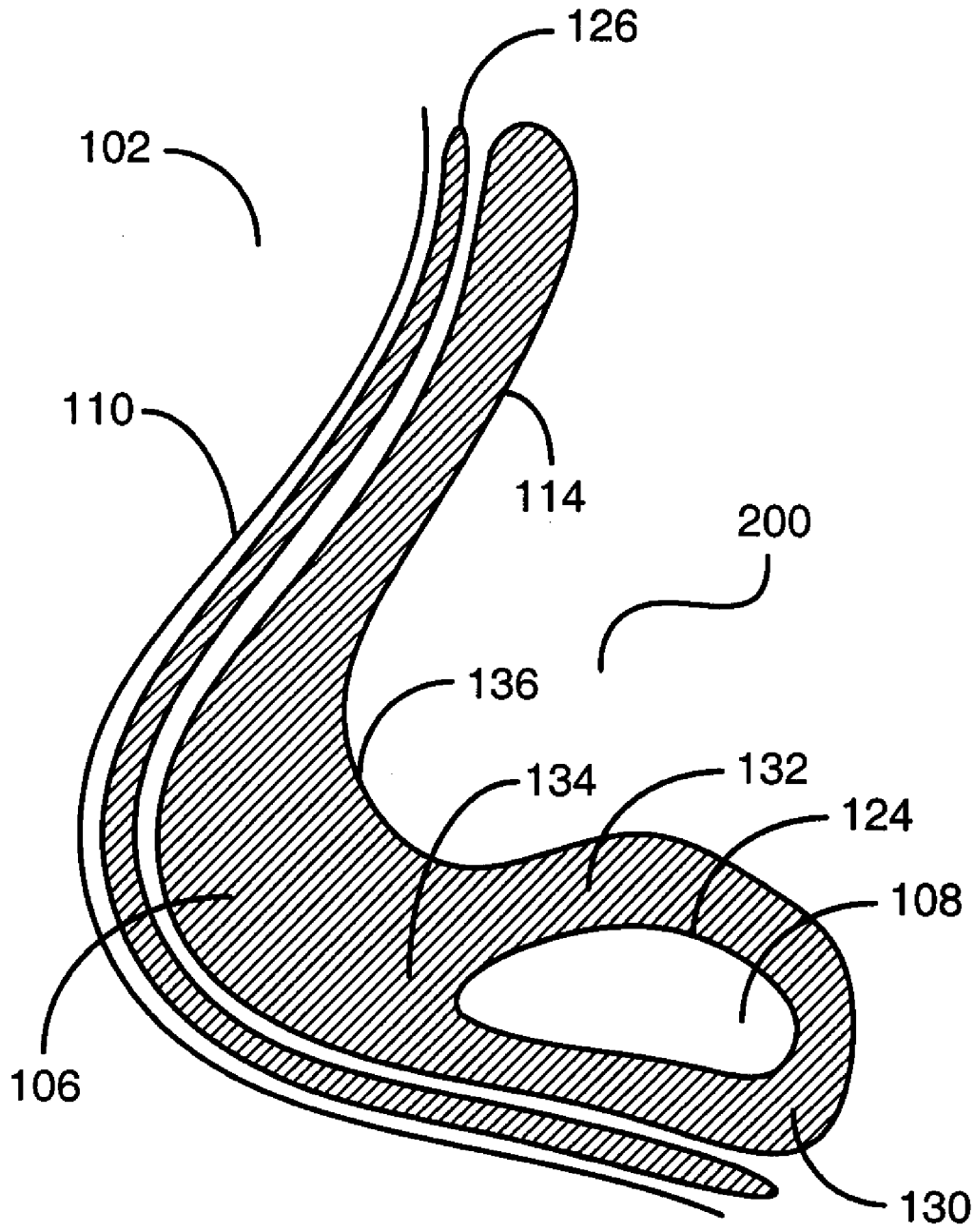
FIG. 3 is a diagram illustrating a cross sectional view of a bra pad in accordance with the present invention.

Referring to FIG. 3, a cross sectional view of the cup 102 is shown. The inner shell 114 may be formed by the pad portion 106. A breast 200 is shown within the inner shell 114. The cookie portion 108 may have a variety of shapes and/or sizes. In the example shown, the cookie portion 108 has a generally tear-dropped shape. However, other shapes may be implemented to meet the design criteria of a particular implementation. For example, the cookie portion 108 may run the length of the bottom portion 130 of the pad portion 106. In one example, the cookie portion 108 may have a protrusion 124. The protrusion 124 may be located near a portion of the cup 102 that would normally sit near the under arm (e.g., towards the inside portion 132 of the pad portion 106). In one example, the cookie portion 108 may be built into the thickest part of the pad portion 106, along the bottom portion 130. In one example, the protrusion 124 may be the same thickness as the bottom portion 130. The protrusion 124 may gradually become thinner, or may taper down towards the upper edge 134. In one example, an additional pad 126 may be implemented. The pad 126 may be located between the inner shell 114 and the outer shell 110. The pad 126 may be made from a flexible material, such as a gel, foam gel, saline, or other types of non-solid substances and/or materials.

A cookie portion 108 may aid in providing the appearance of a full, symmetrical and/or desirable shape to the breast 200. The pad portion 106 may provide a cavity 136 where the breast 200 fits. The pad portion 106 may take the shape of a smaller and/or irregularly shaped breast 200. The cookie portion 108 and/or the pad portion 106 may fill in voids caused by surgery, birth defects and/or other deformities.

In one implementation, a number of pre-formed cups 102 may be formed having a range of thicknesses and/or sizes of inner shell 114. Each of the sizes of the cups 102 may be designed to build up a smaller, misshapen, and/or irregularly shaped breast 200 to have the appearance of a similarly sized and/or shaped larger breast. The thicknesses and/or sizes of the cup 102 may be designed to a variety of ranges of thickness of size of the inner shell 114. For example, a breast having a size B-cup may be designed to have an outward appearance of a breast having a size C-cup. While a B-cup to a C-cup has been described, a variety of sized breast differences or irregularities, including variations in shape, and/or other deformities may be implemented.

Figure 4A:
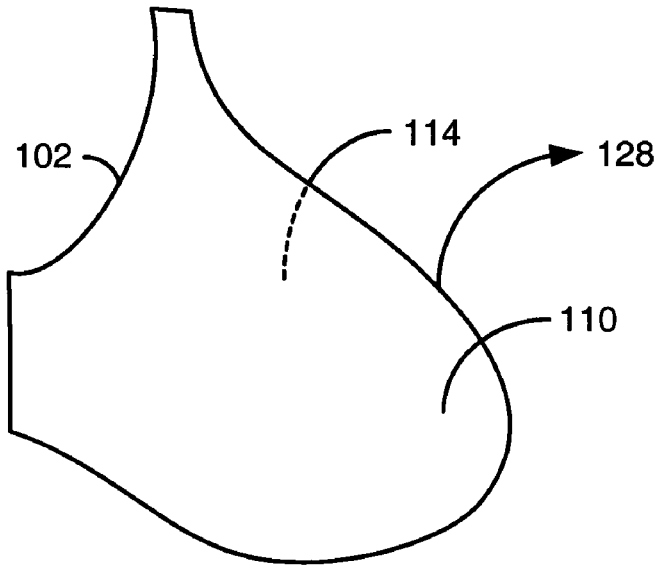
FIGS. 4*a-b* are diagrams illustrating views of an insert of a bra in accordance with the present invention.
Figure 4B:
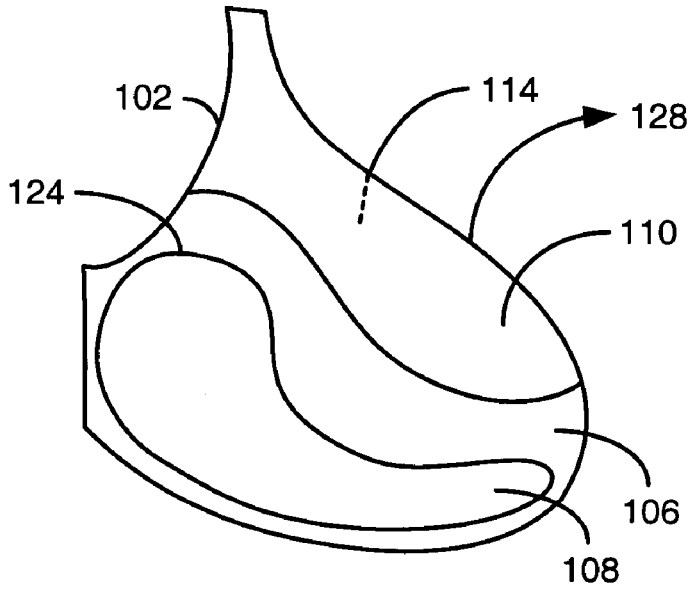

Referring to FIG. 4*a*, an outside view of the cup 102 is shown. Referring to FIG. 4*b*, an alternate inside view of the cup 102 is shown. The cup 102 may be formed having a range of thicknesses. In one example, the pad portion 106 may be thicker at the bottom section of the cup 102. The pad portion 106 may run the length of the bottom up to the top side near the under arm. In one example, the pad portion 106 may gradually become thinner going into the top, inside section of the cup 102. The pad portion 106 normally forms the inner shell 114. In one example, the thickest part of the pad portion 106 may be the cookie portion 108. The cookie portion 108 may run along the entire bottom of the cup. In one example, the cookie portion 108 may start from just under the arm. The cookie portion 108 may have a small, rounded protrusion 124 going inward towards the inside of the cup 102. The cookie portion 108 may then run along the bottom of the cup 102 in a crescent shape design. The cookie portion 108 may also provide evenness to the cleavage area, as shown by an arrow 128. The cookie portion 108 may provide symmetry to the appearance of the outer shell 110.

Figure 5:
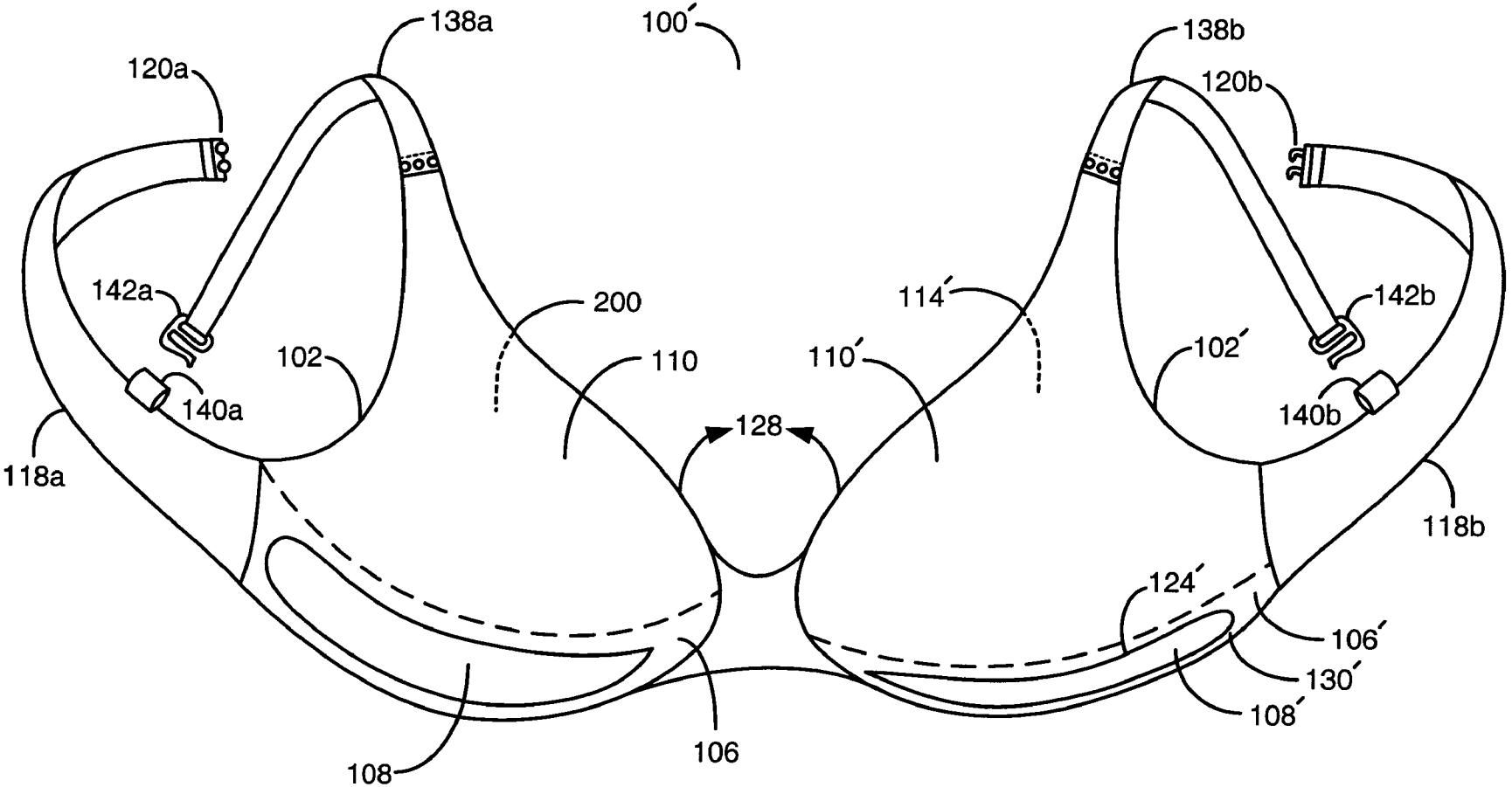
FIG. 5 is a diagram illustrating a size enhancement embodiment of the present invention.

Referring to FIG. 5, a bra 100' is shown illustrating an alternate embodiment of the present invention. In addition to the pad portion 106 and the cookie portion 108, an additional pad portion 106' and an additional cookie portion 108' may be implemented. The pad portion 106' and the cookie portion 108' may enhance the breast without a deformity. A cup 102' may implement the pad portion 106' near the bottom portion 130' of the cup 102'. The thickest part of the pad portion 106' may be implemented as the cookie portion 108'. The cookie portion 108' may run along the entire bottom of the cup 102'. The cookie portion 108' may start from just under the arm. The cookie portion 108' may have a small rounded protrusion 124' near the inside of the cup 102'. The cookie portion 108' may then run along the bottom of the cup 102'. The cookie portion 108' may have, in one example, a crescent shape design. The crescent shape of the cookie portion 108' may push the breast upward and over towards the cleavage area, as shown by an arrow 128.

The cup 102' may be designed to hold a breast that is not misshapen and/or undersized. The cup 102' may contain enough padding in pad portion 106' to increase the size of the larger breast. Similar to the cup 102, the cup 102' may have an outer shell 110' that may be larger than the inner shell 114'. The cup 102 may contain enough padding in pad portion 106 to increase the appearance of the size of the smaller breast 200 to match the enhanced size of the larger breast. The outer shell 110 may appear to be the same size as the outer shell 110'.

The straps 118*a* and 118*b* may connect in the back via connecting devices 120*a* and 120*b*. The straps 138*a* and 138*b* may connect to the bra 100' via connecting devices 142*a* and 142*b*. The connecting devices 142*a* and 142*b* may connect to the connecting device 140*a* and the connecting device 140*b*, respectively. The straps 138*a* and 138*b* may be easily removable and/or replaceable with alternative straps. For example, the straps 138*a*-138*b* may be replaced with a particular color and/or design that may accent a particular wardrobe.

Figure 6:
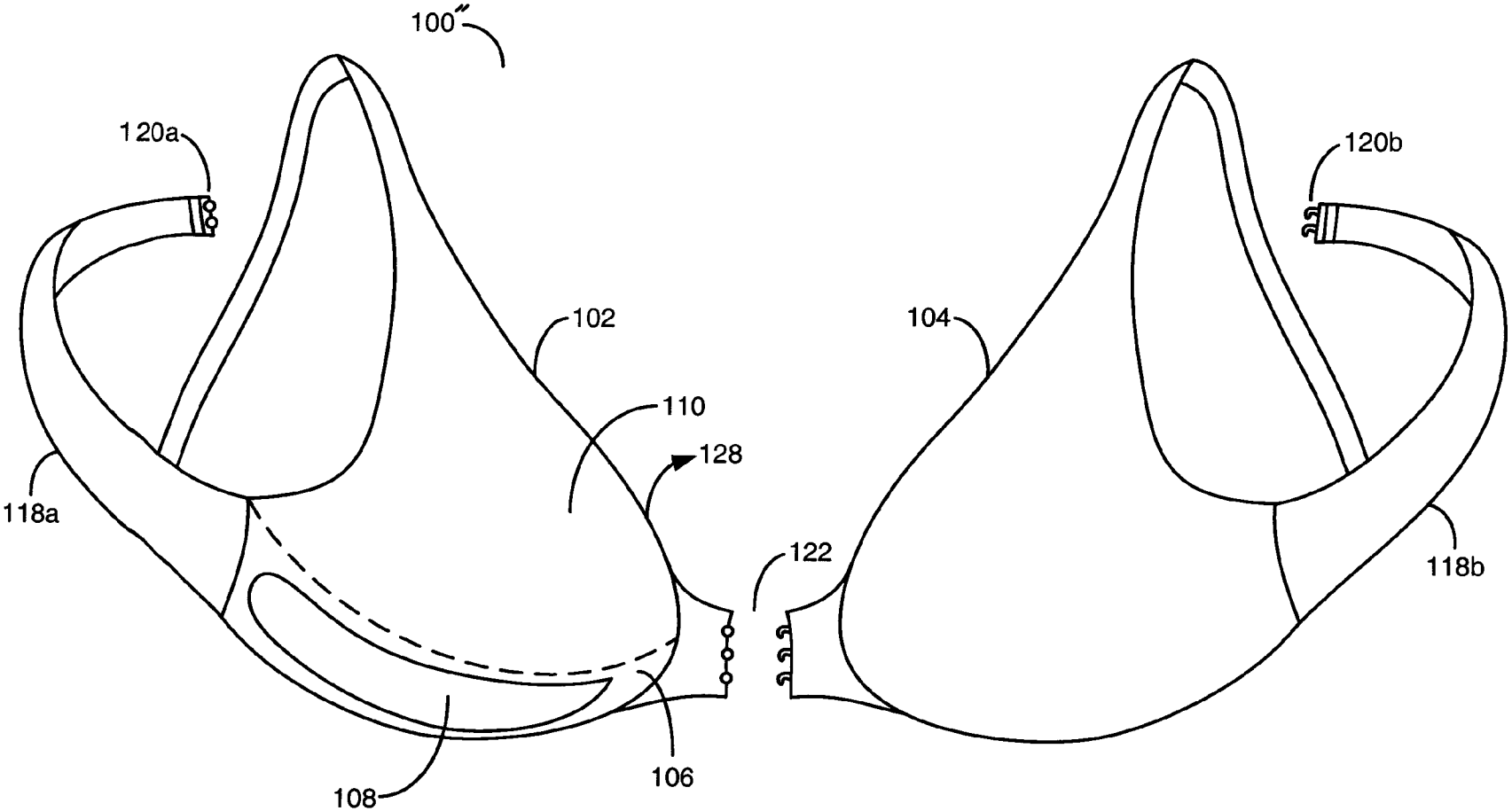
FIG. 6 is a diagram illustrating a two-piece embodiment of the present invention.

Referring to FIG. 6, a bra 100" is shown illustrating an alternate embodiment of the present invention. The bra 100" may be implemented as a two-piece design. In one example, the bra 100" may be implemented as a kit. The bra 100" may be designed as two pieces. The bra 100" may be implemented as having a cup 102 and a cup 104. The cup 102 and the cup 104 may vary in thickness. The cup 104 may also be implemented similar to the cup 102' of FIG. 5. A device 122 may be implemented towards a front portion of the bra 100". The device 122 may be used to connect the cup 102 and the cup 104. The device 122 may be implemented to provide a removable connection. The device 122 may be implemented as various sized clasps, rings, straps, and/or any other suitable connecting devices.

The device 122 may be implemented to adjust the cup 102 and the cup 104 to a specific comfort level. For example, the connecting device 122 may be adjusted to provide enhancement to the cleavage to accommodate particular needs and/or desires. The connectors 120*a* and 120*b* may connect the strap 118*a* to the strap 118*b*. The connectors 120*a* and 120*b* may be implemented as connectors similar to the device 122.

When assembled, the bra 100" may give the appearance of symmetry to otherwise asymmetrical breasts. The outer shell 110 may appear larger than the actual size of the breast being enhanced. The pad portion 106 and the cookie portion 108 may provide extra enhancement to the cup 102. The device 122 may provide an adjustment to the cleavage area, as shown by an arrow 128. The device 122 may allow adjustments to a particular level of comfort.

Figure 7:
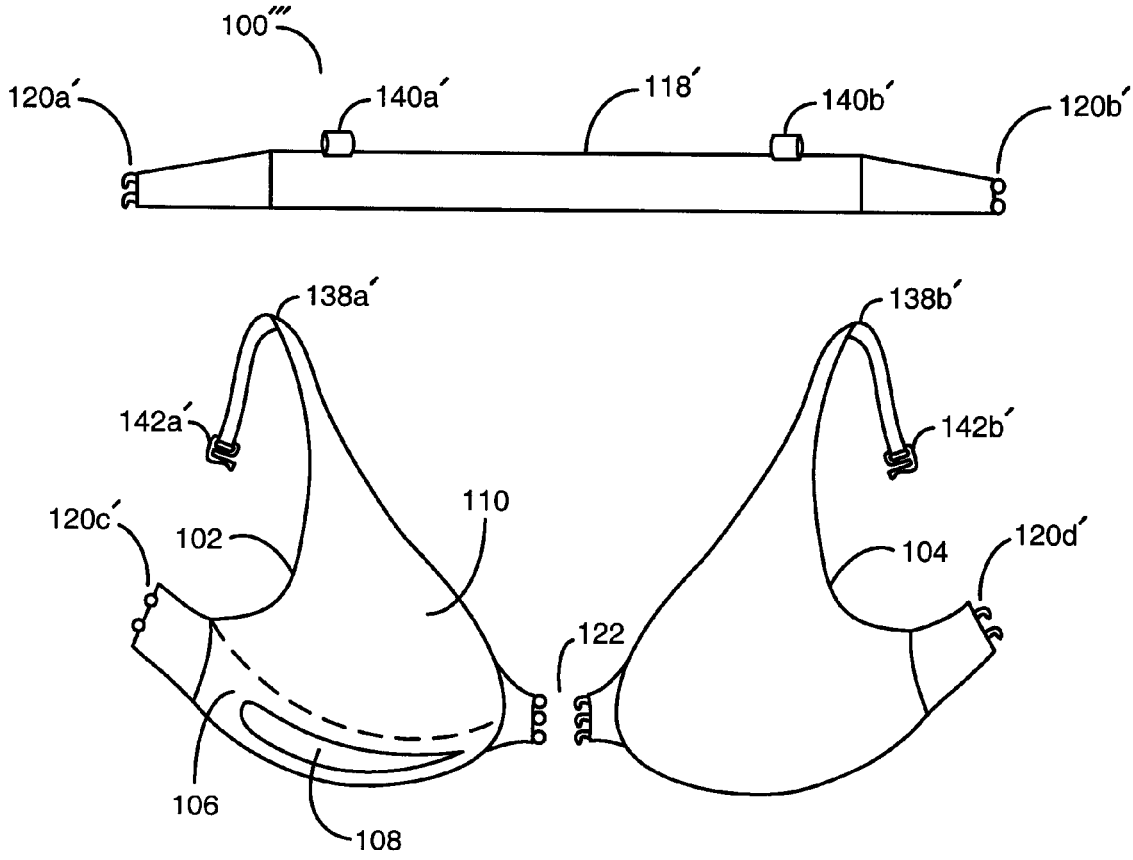
FIG. 7 is a diagram illustrating a three-piece embodiment of the present invention.

Referring to FIG. 7, a bra 100'" is shown illustrating a alternate embodiment of the present invention. The bra 100'" may be implemented as a three-piece design. In one example, the bra 100'" may be implemented as a kit. The bra 100'" may be designed as three pieces. The bra 100'" may include the cup 102, the cup 104, and a back strap 118'. The back strap 118' may be implemented separately from the cup 102 and the cup 104. The back strap 118' may be connectable to the cup 102 and to the cup 104. The cup 104 may also be implemented similar to the cup 102' of FIG. 5. The cups 102 and 104 may connect to the strap 118' through the connection devices 120*a*', 120*b*', 120*c*' and 120*d*'. The connection devices 120*a*', 120*b*', 120*c*' and 120*d*' may be adjustable to allow optimal comfort. The connector devices 120*c*' and 120*d*' (on either side of the cup 102 and the cup 104) may be sewn and/or otherwise attached to the cup 102 and the cup 104 to allow connection to the strap 118'. The connector devices 120*a*' and 120*b*' (on either side of the strap 118') may be sewn to the strap 118'. This may allow a user to have a variety of options when adjusting the size of the strap 118' to a desired comfort level. For example, a user may adjust the strap 118' to work as a size 34 band size. The strap 118' may later be adjusted to work as a size 36 band size. The device 122 may be implemented to connect the cup 102 and the cup 104. The strap 118' may include a connecting device 140*a*' and a connecting device 140*b*'. The strap 138*a*' may include a connecting device 142*a*'. The strap 138*b*' may include a connecting device 142*b*'. While the connecting device 140*a*' and the connecting device 140*b*' are shown as loops, other connectors such as claps, rings, etc. may be implemented. The connecting devices 142*a*' and 142*b*' may connect to the connecting devices 140*a*', and 140*b*'.

The bra 100'" may give the user a customized fit. The pad portion 106 and the cookie portion 108 may be implemented and adjusted to conform to a breast without changing the appearance of the outer shell 110. The outer shell 110 normally maintains a shape substantially consistent with the outer shell 112. The bra 100'" may provide a variety of adjustments. For example, the bra 100'" may provide adjustment from (i) asymmetrical to symmetrical, (ii) smaller to larger, (iii) a small amount of cleavage to a large amount of cleavage, and/or (iv) a tighter band support to a looser band support. The various adjustments may be made to accommodate the needs and/or desires of a user.

While the invention has been particularly shown and described with reference to the preferred embodiments thereof, it should be understood that variations in form and details of the preferred embodiments such as, but not limited to, modifications, equivalents and substitutions for components and/or additions to components of the specifically described embodiments of the invention, may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation of form and details.

The invention claimed is:

1. A breast covering garment apparatus comprising:

a first breast cup comprising (i) an inner shell having a concave shape selected from a number of available cup sizes and (ii) an outer shell having a convex shape selected from a number of available breast cup sizes, wherein said inner shell of said first breast cup and said outer shell of said first breast cup are shaped from a first solid piece of flexible material; and a second breast cup comprising (i) an inner shell having a concave shape selected from said number of available cup sizes and (ii) an outer shell having a convex shape selected from said number of available breast cup sizes, wherein said inner shell of said second breast cup and said outer shell of said second breast cup are shaped from a second solid piece of flexible material, wherein (i) said inner shell of said first breast cup and said inner shell of said second breast cup are different breast cup sizes and (ii) said outer shell of said first breast cup and said outer shell of said second breast cup are the same breast cup size.

2. The apparatus according to claim 1, wherein (i) said first breast cup is molded from said first piece of solid flexible material and (ii) said second breast cup is molded from said second piece of solid flexible material.

3. The apparatus according to claim 1, wherein (i) said inner shell of said first breast cup and said outer shell of said first breast cup are seamlessly molded from said first piece of solid flexible material and (ii) said inner shell of said second breast cup and said outer shell of said second breast cup are seamlessly molded from said second piece of solid flexible material.

4. The apparatus according to claim 1, wherein (i) said inner shell of said first breast cup and said outer shell of said first breast cup are seamlessly molded by compressing said first piece of solid flexible material and (ii) said inner shell of said second breast cup and said outer shell of said second breast cup are seamlessly molded by compressing said second piece of solid flexible material.

5. The apparatus according to claim 1, wherein said first an second pieces of solid flexible material comprise foam.

6. The apparatus according to claim 1, wherein said outer shell of said first breast cup and said outer shell of said second breast cup are symmetrical.

7. The apparatus according to claim 1, wherein said inner shell of said first breast cup and said inner shell of said second breast cup are (i) different cup sizes from one another and (ii) different cup sizes from said outer shell.

8. The apparatus according to claim 4, wherein said flexible material comprises gel.

9. The apparatus according to claim 1, wherein said first breast cup includes a void.

10. The apparatus according to claim 9, wherein said void is configured to be filled with one or more gel pads.

11. The apparatus according to claim 9, wherein said void is configured to be filled with a core pad.

12. The apparatus according to claim 9, wherein said void is configured to be filled with a plurality of core pads.

13. The apparatus according to claim 11, wherein said core pad is connected to said first breast cup or said second breast cup with adhesive.

14. The apparatus according to claim 11, wherein said core pad is fused to said first breast cup or said second breast cup.

15. The apparatus according to claim 11, wherein said core pad is laminated to said first breast cup or said second breast cup.

16. The apparatus according to claim 1, wherein said first breast cup and said second breast cup are individually manufactured and later selected and assembled in response to particular needs of a user.

17. The apparatus according to claim 1, wherein said first breast cup and said second breast cup are connected by a connecting device.

18. The apparatus according to claim 17, wherein said connecting device comprises one or more clasps.

19. The apparatus according to claim 18, wherein said first breast cup and said second breast cup are further connected by a strap.

20. The apparatus according to claim 19, wherein said first breast cup and said second breast cup are further connected by a side coupling device.

* * * * *